United States Patent [19]

Herschberg

[11] 4,123,875

[45] Nov. 7, 1978

[54] WEATHER SEAL

[76] Inventor: Allan F. Herschberg, 3909 W. River La., Brown Deer, Wis. 53209

[21] Appl. No.: 840,923

[22] Filed: Oct. 11, 1977

[51] Int. Cl.[2] ..... E06B 7/22

[52] U.S. Cl. ..... 49/482; 49/480

[58] Field of Search ..... 49/481, 482, 480, 485, 49/309, 488

[56] References Cited

U.S. PATENT DOCUMENTS

| | | | |
|---|---|---|---|
| 232,387 | 9/1880 | Browne | 49/482 |
| 1,837,959 | 12/1931 | Gaskin et al. | 49/482 |
| 3,341,975 | 9/1967 | Tylisz | 49/485 |
| 3,512,303 | 5/1970 | Wright | 49/309 |

FOREIGN PATENT DOCUMENTS

| | | | |
|---|---|---|---|
| 216,310 | 1/1957 | Australia | 49/482 |
| 534,480 | 1/1922 | France | 49/480 |
| 693,763 | 7/1953 | United Kingdom | 49/480 |

*Primary Examiner*—Kenneth Downey
*Attorney, Agent, or Firm*—Ralph G. Hohenfeldt

[57] ABSTRACT

A weather seal for the bottom edge of a swinging door comprises a roller covered with a compressible material such as carpeting. The roller is supported for rotation on spring biased arms that are attached to the door. The arms press the roller into sealing relationship with the door and doorsill when the door is closed and permit the roller to rise and fall as required to clear obstructions or irregularities in the surface over which the door swings as it is being opened. At least one end of the roller which is at the hinge edge of the door is made as a flexible tube so it will bend if it is obstructed by a wall as the door is swung open.

9 Claims, 5 Drawing Figures

WEATHER SEAL

BACKGROUND OF THE INVENTION

This invention relates to a weather seal device for the bottom of a door in a building.

It is common knowledge that doors which have been installed for a long time may shrink and warp and become poorly fitted so a substantial amount of outside air may leak into a building at the joint between the lower edge of the door and the sill or floor over which the door is hung. Sometimes doors are poorly fit during original installation so there is a substantial gap at the bottom. The draft that results makes the occupants of the building uncomfortable and it imposes a greater load on the heating system of the building.

A variety of devices have been proposed for making a seal between the bottom inside edge of a door and the floor or the doorsill. Most of these devices use solid or semisolid sealing elements which are somewhat effective when the door is closed, but they have the disadvantage of not being capable of clearing obstructions or adjusting to irregularities in the floor when the door is being swung open. In many households, a small carpet or mat is placed adjacent the door which may bunch up and impose a heavy drag on the door by virtue of the sealing element which is mounted on the door encountering the mat or rug.

A solution to the problem of the door seal encountering obstructions is found in prior art devices that use rollers to produce the seal. A prior door edge weather seal that uses rollers is shown in U.S. Pat. No. 370,207. In this patent, the seal comprises a plurality of roller segments which are stacked on a shaft over such length as to substantially equal the width of the door. The shaft is carried at the opposite ends of a flat spring which is under the edge of the door and presses the rollers into contact with the sill or floor.

Another prior seal is shown in U.S. Pat. No. 1,837,959. This seal comprises a solid roller having a length substantially equal to the width of the door. The roller is covered with a tube of carpeting material. Shafts extend from the ends of the roller. Mounting brackets are fastened to the door. Arms are pivotally connected to the brackets and the arms have vertical slots in which the shafts rest. The pivoting action of the arms and movement of the rollers in the slots permits gravity to act on the roller to effect a seal. The slots and pivotal action also enable the roller to adjust for any obstructions which may be encountered as the door is swung open.

Another prior seal is shown in British Pat. No. 693,763. It also uses a solid roller having a length about equal to the width of a door and has shafts which are carried in an angulated slot in door mounted brackets. A compression spring acts on the shafts in the slot to effect a seal and to allow the roller to yield upwardly if it encounters obstructions.

A characteristic of prior art roller type door weather seals is that they are always shorter in axial length than the width of the door. As a result, leaks still exist adjacent the ends of the roller. The reason the rollers are made short of the door width is that if they were made as long as or longer than the door is wide, they would swing into the adjacent wall or door frame at the hinge edge of the door when an attempt is made to swing the door through a substantial opening angle. It is apparent that the roller type weather seals of the prior art would be damaged by colliding with a wall or door frame if they were made as long as they should be to produce a complete seal across the width of the door at its bottom edge.

Outside doors are usually installed in original construction by craftsman who have the tools and skills for testing the way the door fits into its frame and sill and they shave or otherwise reshape the door and its sill or its frame until a good seal is obtained without the door fitting too tightly to be opened and closed easily. However, as doors age, they often shrink or distort and form a gap between their bottom edge and their sill which allows cold air to blow into the building. Householders may then be faced with the problem of building up or replacing the sill. Many householders do not have the strength for handling the door nor the skills nor tools for installing a new sill, door or frame. They will, however, ordinarily have the ability to install one of the new weather seal devices made in accordance with the invention hereinafter described.

SUMMARY OF THE INVENTION

A general object of the present invention is to overcome the above noted and other disadvantages in prior door seals.

A more specific object is to provide a door seal which can be installed by anyone who has the minimal skill required to drive a few screws.

Another object is to provide a seal which readily adjusts itself to substantial impediments which may be in the way when the door is being opened.

Another most important object is to provide a weather seal device comprising a roller which covers the entire width of the door and which has a flexible element at one end which yields by bending or compressing when it is swung into a wall or door frame side.

In general terms, a preferred embodiment of the new seal comprises a roller that is preferably made of wood. The roller is journaled for rotation on mounts which are fastened to the door. The roller has a pliable or deformable periphery which contacts the door and its sill or the adjacent floor to form a seal when the door is closed. In the preferred embodiment, an end section of the roller assembly comprises a rubber tube that is also covered with the pliable material with which the principle part of the roller assembly is covered. The tube and roller are coaxial. The tube extends beyond the width of the door by a sufficient amount to cover any gap that might exist at the lower corner of the door.

How the objects mentioned above and other more specific objects of the invention are achieved will be evident in the ensuing more detailed description of illustrative embodiments of the invention in which reference will be made to the drawing.

DESCRIPTION OF A PREFERRED EMBODIMENT

Figure 2:
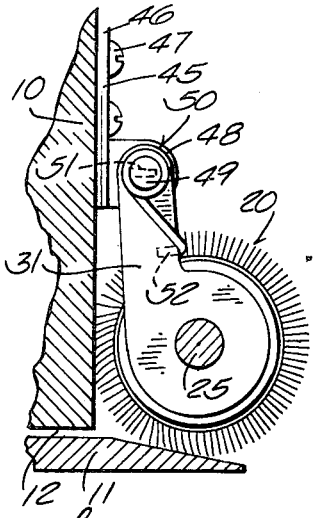
FIG. 2 is a section taken through the assembly along the offset line corresponding with 2—2 in FIG. 1.
Figure 1:
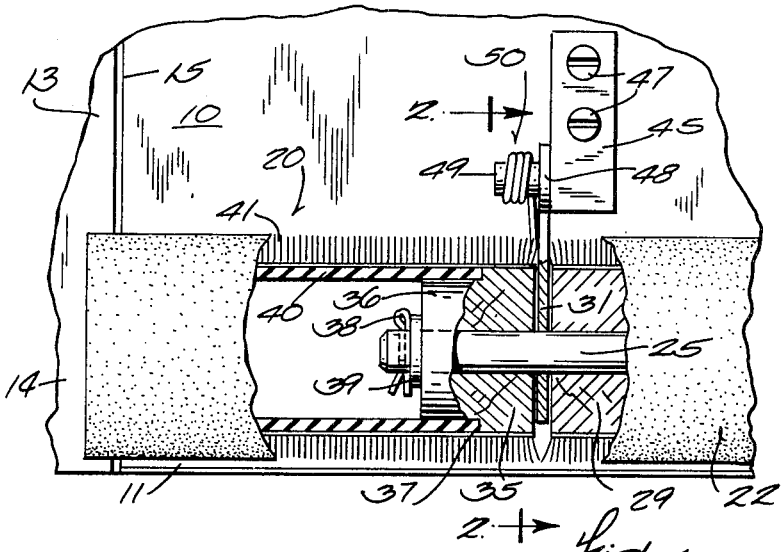
FIG. 1 is an elevation view of the new roller type weather seal mounted adjacent the lower edge of a door with parts of the door assembly being broken away to show its construction.

FIG. 1 shows a broken away lower portion of a door panel 10 which is also shown fragmentarily in FIG. 2 where it is evident that the door is disposed over a sill 11. There is a gap 12, through which air might leak, between the bottom edge of door 10 and sill 11.

In FIG. 1, a portion of the wooden trim 13 is shown fastened to the wall 14 adjacent the edge 15 of the door to which the hinges, not shown, are attached.

Figure 3:
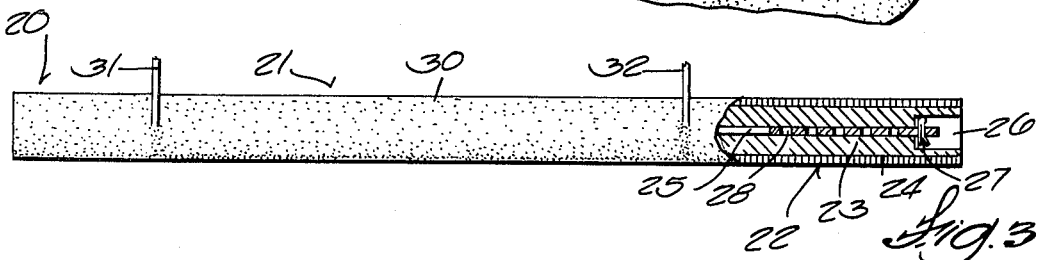
FIG. 3 is a plan view of the roller seal assembly with the end opposite of the end that is shown in FIG. 1 broken away to reveal its internal construction.

A general view of the roller assembly is shown in FIG. 3. It comprises three axially arranged sections 20, 21 and 22. End section 22 may be seen to comprise a cylindrical core or roller 23 which is preferably made of wood. Core 23 has a pliable material such as carpeting material 24 wrapped around and adhered to it. Core 23 has a central bore for accommodating a shaft 25 and the core has a counterbore 26 in one end. Shaft 25 extends into the counterbore. A cotter pin 27 extends through a suitable hole in the shaft for retaining the core 23 on the shaft. Shaft 25 has several diametral holes such as the one marked 28 which are also capable of accommodating a cotter pin. This permits using the same basic shaft for roller assemblies of different widths for it is only necessary to cut the shaft so that at least one hole 28 is available in the counterbore for inserting the retaining pin 27.

The center section 21 of the roller assembly in FIG. 3 also comprises a wooden core 29, see FIG. 1, which is covered with pliable material 30 as is roller section 22. The core in section 21 is suitably bored for shaft 25 to extend through it. Sections 20 and 21 have a thin metal arm 31 interposed between them and sections 21 and 22 also have a similar arm 32 interposed between them. These arms are for supporting the roller assembly on the door as will be explained in greater detail later. Arms 31 and 32 have holes in them for shaft 25 to pass through them.

Construction of end section 20 of the roller assembly may be seen best in FIG. 1. It comprises a short wooden cylinder 35 which serves as a core. Core 35 has a diametrally reduced portion 36 which results in an annular shoulder 37 being created. Core 35 is retained on shaft 25 by any suitable means such as with a cotter pin 38 that has a washer 39 interposed between it and the core.

A rubber tube 40 extends coaxially from core 35 and is fastened to the diametrally reduced portion 36 of the core with adhesive. The tube is preferably open at its left end in FIG. 1. In an actual embodiment, tube 40 is made of surgical rubber and has a wall thickness of about one-eighth of an inch. Tube 40 is also covered with a deformable material such as carpeting 41 which is preferably glued to the exterior of the tube.

Figure 4:
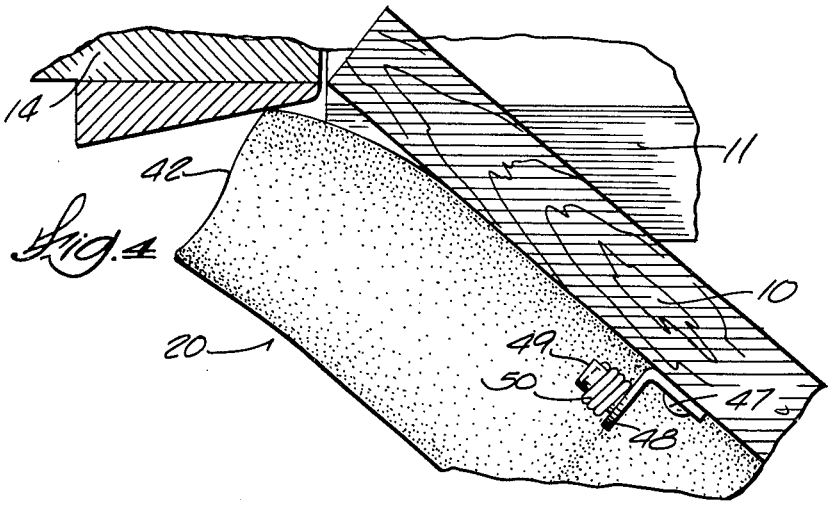
FIG. 4 is a plan view of a portion of a door frame and a door which is shown in partially open position to illustrate how the flexible member at the end of the roller assembly yields without damage to the roller when the door is swung open.

FIG. 4 shows how the end section 20 having the carpet covered rubber tube performs when door 10 is swung open. Under this condition, the end 42 of flexible section 20 strikes the door frame trim 13 and easily deforms without any damage being done to the roller assembly and without interfering with the door being opened fully. When the door is closed again as in FIG. 1, end section 20 is restored to its cylindrical shape again as a result of its inherent resiliency.

As indicated above, the sealing roller assembly is supported on arms 31 and 32. A typical arm 31 is shown in FIG. 2. Shaft 25 extends through the rollers and arms 31 and 32 as well. Typical arm 31 is pivotally mounted to a bracket 45 which has a flat base 46 that is secured on the door 10 with screws such as the one marked 47. There is an upstanding tongue 48 projecting from bracket base 46. A pin 49 is secured in tongue 48. A torsion spring 50 surrounds the pin. An end 51 of the torsion spring extends through a hole in the pin and the other end 52 of the spring is hooked onto arm 31. As is self-evident, the torsion spring is preloaded at the time of assembly so it will exert a clockwise torque on arm 31 as viewed in FIG. 2. When the door is closed as in that figure, the spring presses the carpet coated roller assembly into sealing relationship with the face of door 10 and with the sill 11.

If the door encounters obstructions along the floor surface as it is being swung open, a torque is developed by arm 31 which overcomes the torque of the spring and the roller assembly rises and rolls over the obstruction. The roller assembly turns as it rolls along so no dragging effect is felt when the door is being opened.

Figure 5:
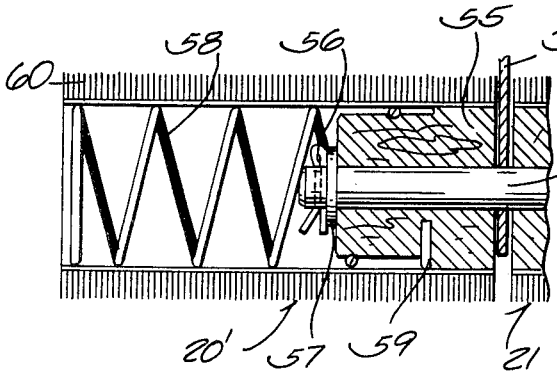
FIG. 5 is an alternative form of yieldable end portion for the roller assembly.

A modified form of compressible or deformable end section for the roller assembly is shown in FIG. 5. It is generally designated by the reference numeral 20'. The same shaft 25, mounting arms 31 and middle section 21 of the roller assembly may be used as in the previously described embodiment. In FIG. 5, a short core section 55 is fitted on shaft 25 and is retained on it by a cotter pin 56. A washer 57 is disposed between the cotter pin and core section. In this embodiment, the capability of the end section of the roller assembly flexing or deforming when it is swung into a wall or woodwork adjacent the door is obtained with a coil spring marked 58. One end 59 of this spring penetrates a suitable hole in core 55 to retain the spring on the core. The outer diameter of the spring 58 and core 55 are covered with pliable material such as carpeting 60.

Section 20' undergoes the same deforming action as section 20 in FIG. 4 when the door is opened. That is, spring 58 bends crosswise of its axis when its end strikes a wall or other obstruction incidental to the door being opened. When the door is closed, of course, spring 58 straightens out as shown in FIG. 5 so the tubular carpeting material 60 will make continuous contact with the door surface and effect a good seal.

Although embodiments of a roller type door seal having a bendable and self-restoring end section have been described in considerable detail, such description is intended to be illustrative rather than limiting, for the invention may be variously embodied and is to be limited only by interpretation of the claims which follow.

I claim:

1. A device for sealing the bottom edge of a door that is installed in an opening in a structure and is swingable about a vertical axis at a side of said door, said device comprising:

roller means for being mounted for rotation on said door about an axis that is generally parallel to its bottom edge with one part of said roller means extending along said bottom edge of said door substantially on one side of said vertical axis and another part of said roller means extending across said vertical axis beyond a side edge of said door, said other part of said roller means that is for extending across said vertical axis at the side of said door being resilient and capable of bending in response to swinging into said structure when said door is swung open.

2. A device for sealing the bottom edge of a door that is installed in an opening in a structure and is swingable about a vertical axis at a side edge of said door, said device comprising:

first and second coaxial roller elements for being mounted on said door for rotation about a common horizontal axis adjacent said bottom edge of said door, a cylindrical and easily deformable element having an outside diameter substantially equal to the outside diameter of said first roller element and mounted coaxially to said second roller element for extending axially from said first roller element beyond said vertical axis and beyond said side edge of said door, and pliable material surrounding said roller elements and said cylindrical deformable means for effecting a seal at said bottom edge when said door is closed, said easily deformable element being capable of bending in response to swinging into said structure when said door is swung open.

3. The device as in claim 2 wherein said cylindrical deformable element comprises a tube of elastomeric material.

4. The device as in claim 3 wherein said elastomeric material is surgical rubber.

5. The device as in claim 3 wherein said elastomeric material is silicone rubber.

6. The device as in claim 2 wherein said cylindrical deformable element is a helical spring whose axis is coaxial with said roller elements.

7. A device for sealing the bottom of a closed door that is installed in an opening in a structure and is swingable about a vertical axis at a side of said door, said device comprising:

a shaft having a length that is less than the width of said door and means for supporting said shaft adjacent said bottom edge of said door and generally parallel to said bottom edge, first, second and third generally cylindrical cores mounted coaxially on said shaft for rotation, a cylindrical easily deformable means having an outside diameter substantially equal to the outside diameter of said second and third cores and extending axially from said first core across said side edge of said door, and pliable material surrounding said deformable means and said cores for effecting a seal at said bottom edge of said door when it is closed, said deformable means and the pliable material surrounding it being capable of bending in response to swinging into said structure when said door is swung open.

8. The device as in claim 7 wherein said cylindrical deformable means is a tube comprised of elastomeric material.

9. The device as in claim 7 wherein said cylindrical deformable means is a helical spring whose axis is coaxial with said shaft.

* * * * *